United States Patent [19]

Carraro et al.

[11] Patent Number: 4,723,749

[45] Date of Patent: Feb. 9, 1988

[54] CHANNEL CLIP

[75] Inventors: Eugene Carraro, Roslyn Heights, N.Y.; Raymond S. Laughlin, Cuyahoga Falls, Ohio

[73] Assignee: Erico International Corporation, Solon, Ohio

[21] Appl. No.: 864,326

[22] Filed: May 19, 1986

[51] Int. Cl.[4] ..... A47H 1/10

[52] U.S. Cl. ..... 248/317; 24/336; 24/563; 52/39; 248/59; 248/72; 248/322; 248/339

[58] Field of Search ..... 248/317, 59, 322, 339, 248/316.8, 327, 72; 52/39; 403/397; 24/336, 531, 563

[56] References Cited

U.S. PATENT DOCUMENTS

| | | | |
|---|---|---|---|
| 2,064,591 | 12/1936 | David | 24/563 X |
| 2,542,922 | 10/1950 | Moburg | 24/336 X |
| 3,233,297 | 2/1966 | Havener | 403/397 |
| 3,417,535 | 12/1968 | Zuckerman | 248/322 X |
| 3,599,921 | 8/1971 | Cumber | 248/317 |
| 3,602,473 | 8/1971 | Van Riet et al. | 248/317 |
| 3,608,857 | 9/1971 | Hibbeler | 248/317 |
| 3,837,609 | 9/1974 | Weiss et al. | 248/317 |
| 4,030,966 | 6/1977 | Horning et al. | 24/336 X |
| 4,560,126 | 12/1985 | Judkins et al. | 248/72 |

*Primary Examiner*—Ramon O. Ramirez
*Attorney, Agent, or Firm*—Renner, Otto, Boisselle & Lyon

[57] ABSTRACT

This invention relates to a construction fastener and more specifically to a clamp or clip for securing a horizontally extending channel to another hoizontally or vertically extending construction element of miscellaneous configuration. The fastener is formed from a strip of resilient metal or spring steel and at least one end includes a notched portion for engaging a horizontally extending channel. The notched portion is oriented with respect to the horizontal channel such that the longitudinal planar surface of the notched portion is normal to the horizontal axis of the channel. The notched portion includes a cam-like spring tab adapted to spring out of the way and to snap back and lock behind the channel when the channel is inserted into the notched portion. The opposite end of the fastener, which may be engaged or disengaged with or without the channel in the notched portion, may comprise a wire or rod receiving notched portion or it may comprise one of a variety of forms capable of engaging vertically or horizontally extending construction elements of miscellaneous configuration.

29 Claims, 13 Drawing Figures

CHANNEL CLIP

DISCLOSURE

This invention relates to a channel clip and more particularly to a construction fastener such as a clamp or clip for securing a horizontally extending channel to another vertically or horizontally extending construction element of miscellaneous configuration. The channel clip of the present invention relates to certain variations and applications of a channel clip such as shown in applicant's copending applications, each entitled "Channel Clip", filed even date herewith.

BACKGROUND

This invention in addition to having all the advantages of the clip disclosed in such copending applications, has an additional advantage in that it displays improved loading characteristics. Also, in certain circumstances the clip of this invention may be easier to install because the horizontal channel is engaged simply by rolling the channel into notched portion of the clamp. It also has additional versatility.

SUMMARY

In the present invention an improved clip is provided for securing a horizontally extending channel to either a horizontally or vertically extending construction element such that the portion for securing the horizontal channel is aligned with respect to the channel so as to provide optimum load bearing characteristics. The clip may be produced by various techniques known to those skilled in the art but is best produced by stamping a flat blank of metal such as steel to the approximate dimensions of the clip and either press or roll forming the blank to its final configuration. It is then heat treated to provide the desired spring steel characteristics. Additional devices for engaging construction elements may be attached to the clip by various means such as bolting, riveting, welding, and the like.

The clip includes at least one notched portion at one end for engaging a horizontally extending channel. The notched portion is oriented with respect to the horizontal channel such that the major planar surface of the clip at the notched portion is normal to the horizontal axis of the channel. The notched portion includes a cam-like spring tab adapted to spring out of the way and to snap back and lock behind the horizontal channel when the channel is inserted into the opening of the notched portion. The configuration of the notched portion is adapted to the approximate configuration of the horizontal channel so as to allow the notched portion to receive and securely engage the channel.

The opposite end of the clip may comprise a vertical wire or rod engaging notched portion which may be height adjusted regardless of the presence or absence of the channel, or it may comprise one of a variety of forms which are capable of engaging vertically and horizontally extending construction elements of various configurations. More particularly, the opposite end may include a V-shape spring portion for engaging a vertically depending rod, wire or the like, or it may provide simply a plane or bent surface to which may be secured a variety of other types of clips or hasps for support of further structures from a channel. The end may be configured to support a T-bar or it may be provided with a hole through which something further such as a T-bar may be wire supported.

In all forms of the invention the ability to engage or disengage one of the portions located at one of the ends of the clip is independent of whether or not the portion located at the opposite end of the clip is engaged with its respective construction element.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENT

Figure 2:
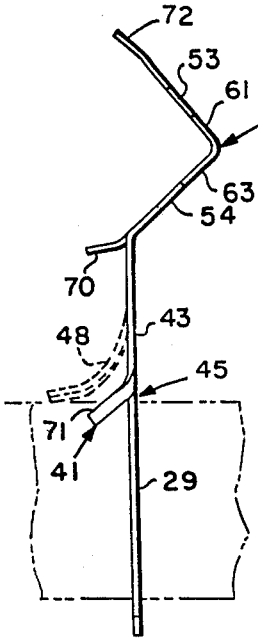
FIG. 2 is an edge elevation after being formed of a clip embodying the invention.
Figure 1:
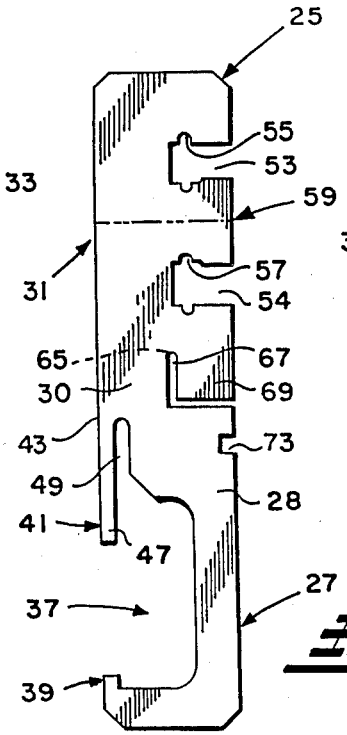
FIG. 1 is a plan view of the metal blank from which the clip of the invention may be formed.
Figure 3:
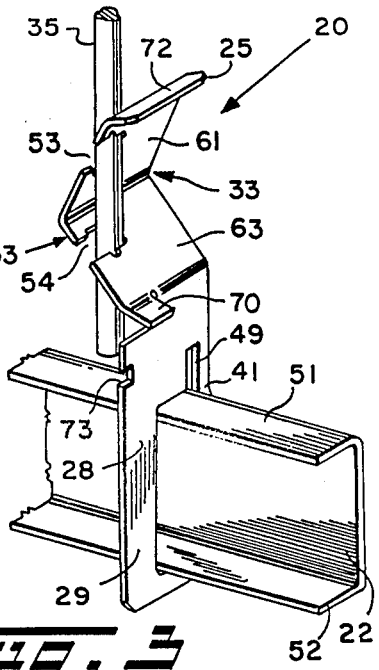
FIG. 3 is an isometric view of one preferred embodiment illustrating the installed clip engaging a vertically depending rod.

Referring in detail to the drawings and initially to FIGS. 1-3, a clip 20 for securing a horizontally extending channel 22 to another horizontally or vertically extending construction element of miscellaneous configuration in accordance with the present invention is shown. The clip 20 shown in FIGS. 2 and 3 is formed from the sheet metal blank shown in FIG. 1. The blank is substantially elongated and of uniform width with the corners cropped as indicated at 25.

The blank is formed at one end portion shown generally at 27 into a notched portion 29 for engaging the channel 22. The other end portion shown generally at 31 is formed, in this particular embodiment of the invention, into a horizontally directed V-shape nose portion 33 for engaging a vertically depending rod 35. Interconnecting the end portion 29 and the other end portion 31 is the vertical portion 30. The planar surface of faces 28 of the notched portion 29 of the clip is normal to the major axis of the horizontally extending channel 22.

The notched portion 29 includes a single opening 37 which is shaped to the general configuration of the horizontal channel 22. The notched portion also includes a short protruding leg 39 forming an end hook 40 and an opposed cam-like spring tab 41 both of which help to secure the channel 22 within the confines of the opening 37. The cam-like tab 41 is formed from the lateral edge 43 of the clip and is twisted at point 45 so that the surface 47 of the cam 41 is at a camming angle so that a force on such surface normal to the plane of FIG. 2 and away from the viewer causes the tab to deflect to the left as seen by the dotted line position 48. It is noted that in order to allow sufficient spring arm movement and thus the proper operation of the cam 41 an extended cut-out 49 which extends well beyond the opening is included.

When the cam 41 is twisted in this manner it will ride along or cam along the side 51 of the channel as the channel is being inserted and will snap behind the channel when the insertion process is complete. Insertion of the channel 22 into the notched portion 29 is easily accomplished by slightly angling the channel and then inserting one leg 52 of the channel into the end of the opening 37 nearest the leg 39. The channel is then twisted or rocked back to its normal or upright position creating the force noted on the cam causing it to spring out of the way and then snap back so that the channel is securely engaged within the notched portion 29.

The V-shape nose portion 33 includes two laterally opening notches 53 and 54 with the parallel upper and lower edges of each notch being provided with a relatively small recess as indicated at 55 so that each of the parallel walls of the notch are provided with relatively sharp corners 57 on each side of the wall recess to bite into and fully engage the rod 35. The nose portion 33 is folded on the line indicated at 59 which is midway between the notches 53 and 54 to form the upper and lower angularly extending legs 61 and 63 of the V of the nose. The lower leg 63 is directed away from the vertical portion 30 of the clip at the fold line 65 which is aligned with the top of an L-shape notch 67 providing a downwardly extending tab 69 on one side of the clip which provides a projection 70 which may extend somewhat parallel to the offset tip 72 of the leg 61 which is formed from the top of the blank.

It is noted in the formed condition seen in FIG. 2, the notches 53 and 54 are vertically aligned. When the V-shape nose portion is squeezed together as between the thumb and forefinger pressing on the portions 70 and 72, the rod will fit freely through the aligned notches as seen in FIG. 2, and when released, the notched edges will bite into and engage the rod by the inherent resiliency of spring steel of the clip.

While the side openings 53 and 54 are preferred, since this permits the clip to be engaged with the rod simply by inserting the clip laterally on the rod when the nose is squeezed and engaged with the rod when the nose is released, it will be appreciated that such notches may be in the form of contained apertures so that the rod would require to be threaded through such apertures when the nose is compressed and engaged when the nose is released.

The edge of the clip just above the notch 37 is provided with a sight notch 73 which facilitates leveling the clips on the rods 35, whether a taut string or more sophisticated laser leveling techniques be employed.

Referring now to FIGS. 4–12, several embodiments of the invention are shown wherein the other end portion 31 has been modified in various ways so as to allow the clip to engage construction elements of various configurations. More particularly, in FIGS. 4 and 5 a preferred embodiment of the invention is shown wherein the other end portion 31 comprises a continuous U-shape spring tab 74 and an opposing spring tab 75 extending from the center of the opening forming the U-shape tab 74 for engaging and gripping an accoustical T-bar 76 equipped with a rectangular bulb 77. Preferably, the U-shape spring tab 74 and the opposing spring tab 75 include bulb retaining tabs or detents 78, 79 and 80 which protrude against and securely snap under and engage the underside of rectangular bulb 77. Such retaining tabs accommodate various sizes and types of bulbs. Additionally, in order to rigidify the clamp ridges 81 and 82 have been included along the legs of the U-shape tab 74. Ridges 81 and 82 extend parallel to the lateral edges of the clamp and they may run its entire length. Although only a T-bar with a rectangular bulb has been illustrated, it will be appreciated that this particular embodiment of the invention may be easily modified to securely engage T-bars with circular or square bulbs.

Figure 4:
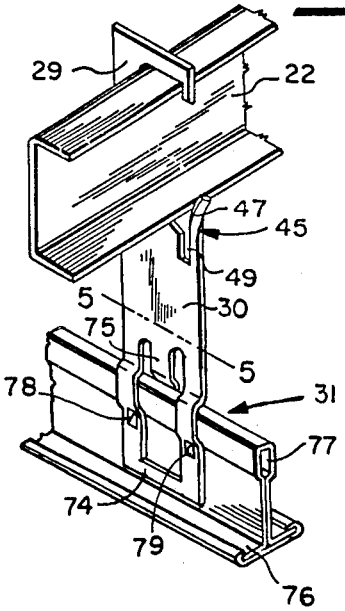
FIG. 4 is an isometric view of an embodiment of the invention suitable for securing a T-bar.
Figure 5:
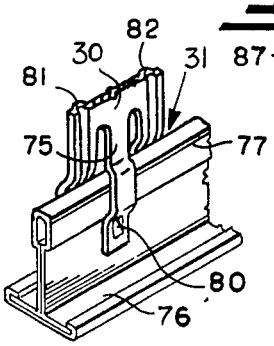
FIG. 5 is a fragmentary isometric view of the lower end of the clip of FIG. 4.

The embodiment of FIGS. 4 and 5 is particularly useful in supporting T-bars at or adjacent lay-in lighting fixtures since the width of the clip at the bulb of the T provides appreciably no obstruction to a lighting fixture positioned on the bottom flange of the T. The clip widens the bulb of the T only by the thickness of the tabs 74 and 75.

Figure 6:
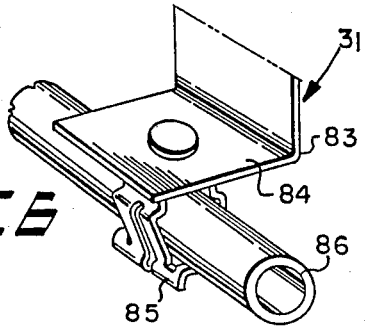
FIG. 6 is a view similar to FIG. 5 of another embodiment of the end suitable for securing a horizontally extending conduit.

In FIG. 6 another form of the other end portion 31 is shown wherein the end of the clamp has been bent 90° at 83 to provide a horizontally extending portion 84 to which has been riveted a spring clamp 85 which is capable of securing a horizontally extending conduit or tube 86.

Figure 7:
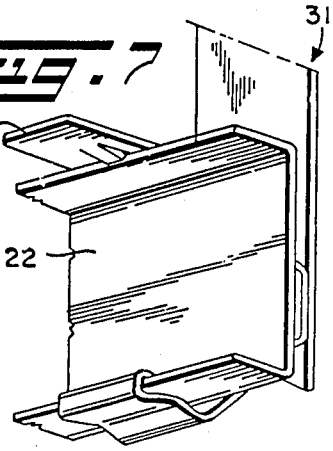
FIG. 7 is a view similar to FIG. 5 of another embodiment of the end suitable for securing a horizontally extending channel.
Figure 8:
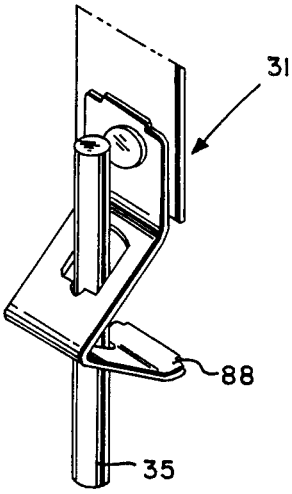
FIG. 8 is a view similar to FIG. 5 of another embodiment of the end suitable for gripping a vertically depending rod.
Figure 9:
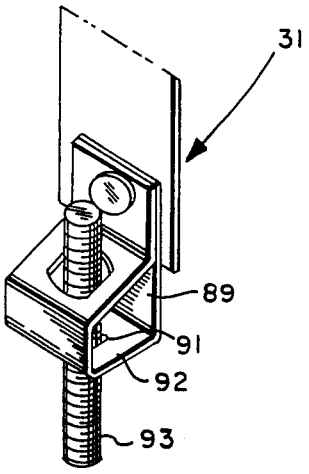
FIG. 9 is a view similar to FIG. 5 of another embodiment of the end suitable for securing a threaded rod.

In FIG. 7 another form of the other end portion 31 is shown wherein the portion includes a C-shape clamp 87 attached at its end for engaging a channel 22. The clamp is riveted to the end 31 and may be similar in construction and operation to the clamp shown in Havener U.S. Pat. No. 3,233,297. In FIG. 8 another form of the other end portion 31 is shown wherein riveted near the end of the portion is a V-shape clamp for securing a vertically extending rod 35. This form of clamp is similar to the integrally formed end portion of FIG. 3 except that the rod engaging portions are formed holes instead of lateral notches. In FIG. 9 another form of the other end portion 31 is shown wherein riveted near the end of the portion is a clamp 89 with a thread form aperture 91 in horizontal wall 92 through which a threaded rod 93 may be threaded and secured.

Figure 10:
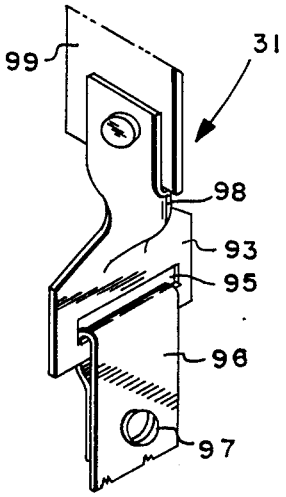
FIG. 10 is a view similar to FIG. 5 of another embodiment of the end suitable for securing a metal strap at an angle normal to the plane of the body of the clip.
Figure 11:
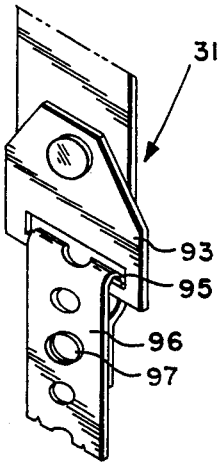
FIG. 11 is a view similar to FIG. 10 of another embodiment of the clip suitable for securing a metal strap at an angle generally parallel to the plane of the body of the clip.
Figure 12:
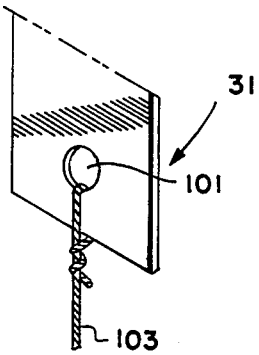
FIG. 12 is a view similar to FIG. 5 of another embodiment of the end suitable for securing a wire.

In FIGS. 10 and 11 another form of the other end portion 31 is shown wherein riveted near the end of the portion is a hasp 93 with a rectangular shape aperture 95 through which a metal strap 96 has been threaded and secured with a fastener 97. It should be noted that the hasp 93 in FIG. 10 has been formed in region 98 such that the hasp is substantially normal to the major plane of vertically extending body 99 of the other end portion. In FIG. 12 yet another form of the other end portion 31 is shown wherein the portion includes a circular opening 101 through which a metal wire 103 may be threaded and tied off.

It will be apreciated after reviewing FIGS. 4–12 that the other end portion 31 of this invention may comprise essentially an endless number of configurations and that the embodiments shown in FIGS. 4–12 are illustrative of just a few such configurations. Also, the configurations of the other ends are essentially in the form of portions of conventional construction fasteners or clips.

Figure 13:
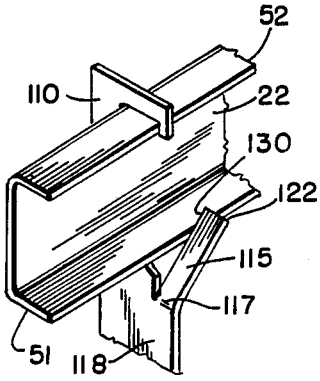
FIG. 13 is a fragmentary isometric view illustrating an alternative preferred embodiment of one end of the clip made in accordance with the present invention.

Referring now to FIG. 13 there is illustrated another embodiment of the notched portion 110. Like the previously illustrated embodiments, the notched portion 110 includes a cam 115. Note however, in this embodiment no twist is included. The cam angle is formed by merely bending the cam 115 at point 117 approximately 45° relative to the surface of the vertical portion 118.

Insertion of the channel 22 into this embodiment of the clip is accomplished like that of the previously illustrated embodiments. Thus, the one leg 52 of the channel 22 is first inserted into the notched portion 110. As the channel 22 is twisted into the notched portion 110 by either twisting the channel 22 or the clip, the end 122 of the cam 115 rides along the side 51 of the channel 22. When the channel 22 is fully positioned within the notched portion 110, the edge 130 of the cam 115 securely engages the channel 22 within the notched portion 110.

It will be appreciated that the notched portions of the invention may be adapted to engage horizontally extending channels of various size and configuration. For example, in addition to being capable of engaging the channel 22 configuration as shown in FIGS. 3, 4 and 13, the notched portion may also be adapted to engage other shape channels or tubes.

With the exception of FIGS. 4 and 5, it should be appreciated that either end of the clip may be up. Thus a component may be hung from a channel or vice versa. In any event because the major plane of the clip extends normal to the axis of the channel greater loading capabilities are obtained. Moreover, the spring tab not only makes the channel easy to install but also secures the channel properly in place in a manner quite evident to the installer.

It will also be understood that the vertical height of the clips may vary and come in different vertical lengths such as 4, 6, 8 or even 12 inches. For example, not all drop ceilings are constructed at the same height, particularly in remodeling or reconstruction projects.

As used herein the term rod or wire may be used interchangeably since smaller rods are perhaps technically wires and larger wires are perhaps technically rods.

We claim:

1. A vertically extending clip for interconnecting two or more building elements comprising sheet metal in strip form, at least one end of which is in the form of a single vertical major plane and which includes a notched portion for engaging a horizontal channel, said notched portion being oriented with respect to said horizontal channel such that said major plane which is also defined by the surfaces of said notched portion is normal to the axis of said horizontal channel, the opposite end of said clip comprising means for engaging and securing horizontal or vertical building elements.

2. The clip of claim 1 wherein said notched portion includes portions at least wholly or partly enclosing both the top and the bottom of said horizontal channel.

3. The clip of claim 1 wherein said notched portion includes a cam-like tab projecting out of said major plane adapted to bear against and secure said horizontal channel in said notched portion when said horizontal channel is inserted into said notched portion.

4. The clip of claim 3 wherein said cam-like tab is formed along one lateral edge of said clip.

5. The clip of claim 3 wherein said cam-like tab is bent to extend at a cam angle to the major plane of said one end of said clip.

6. The clip of claim 5 wherein said tab is of substantial free extent so that it will yield from said major plane of said one end of said clip to permit the channel to be inserted in the notch and then snap back to lock the channel in the notch.

7. The clip of claim 1 wherein said opposite end portion comprises means for releasably clamping a vertically depending rod.

8. The clip of claim 7 wherein said means for releasably clamping include spring means for adjusting the position of said clip relative to the rod while said notched portion for engaging said horizontal channel is engaged with said horizontal channel.

9. The clip of claim 8 wherein said means for releasably clamping said rod comprises a horizontally extending V-shape portion to release said rod when compressed and to grip said rod when released.

10. A clip as set forth in claim 9 wherein said V-shape portion includes at least one projecting tab adapted to facilitate the compression of said V-shape portion.

11. The clip of claim 1 wherein said opposite end portion comprises means for securing a T-bar.

12. The clip of claim 11 wherein said means for securing a T-bar comprises multiple protruding tabs.

13. The clip of claim 12 wherein such T-bar includes a bulb with said protruding tabs comprising spring tabs including portions formed to embrace the bulb on opposite sides.

14. The clip of claim 13 wherein one of said tabs is U-shape and the other is in the center of the U-shape tab.

15. The clip of claim 13 wherein each tab includes a detent adapted to snap under and engage the underside of the bulb.

16. A vertically extending clip for interconnecting two or more construction elements and having a major vertical plane comprising at one end a notch for engaging a horizontally extending channel element, the edges of said notch being in said major vertical plane,and spring cam tab means deflected from said major vertical plane of the clip at least partially closing the opening of the notch and adapted to be cammed out of the way by insertion of the channel into the notch, and, at the opposite end, means for engaging another building element.

17. The clip of claim 16 wherein said notch is formed in an edge of said clip so that the major plane of the clip is normal to the axis of said horizontally extending channel element.

18. The clip of claim 16 wherein said means for engaging another building element comprises a C-shape clamp for engaging a horizontally extending C-shape channel.

19. The clip of claim 16 wherein said means for engaging another building element comprises a horizontal portion which extends at an angle normal to the major plane of said clip.

20. The clip of claim 19 wherein said horizontal portion includes a clamp adapted to receive and engage a horizontally extending conduit.

21. The clip of claim 16 wherein said means for engaging another building element comprises a V-shape nose portion for engaging a vertically depending rod.

22. The clip of claim 16 wherein said means for engaging another building element comprises a fastening device and said fastening device includes an aperture through which a vertically extending threaded rod may be threaded and secured.

23. The clip of claim 16 wherein said means for engaging another building element comprises a hasp through which a strap may be threaded and secured.

24. The clip of claim 16 wherein said means for engaging another building element includes a circular opening through which a wire may be threaded and secured.

25. The clip of claim 17 wherein said opposite end portion comprises means for securing a T-bar.

26. The clip of claim 25 wherein said means for securing a T-bar comprises multiple protruding tabs.

27. The clip of claim 26 wherein such T-bar includes a bulb with said protruding tabs comprising spring tabs including portions formed to embrace the bulb on opposite sides.

28. The clip of claim 27 wherein one of said tabs is U-shape and other is in the center of the U-shape tab.

29. The clip of claim 27 wherein each tab includes a detent adapted to snap under and engage the underside of the bulb.

* * * * *